US006805027B2

(12) United States Patent
Hsien

(10) Patent No.: US 6,805,027 B2
(45) Date of Patent: Oct. 19, 2004

(54) PAWL SELECTION MECHANISM FOR RATCHET TOOLS

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 99 days.

(21) Appl. No.: 10/195,535

(22) Filed: Jul. 16, 2002

(65) Prior Publication Data

US 2004/0011164 A1 Jan. 22, 2004

(51) Int. Cl.[7] ..... B25B 13/46
(52) U.S. Cl. ..... 81/63.2; 192/43.2
(58) Field of Search ..... 81/60, 62, 63.2; 192/43.2

(56) References Cited

U.S. PATENT DOCUMENTS 3,269,496 A * 8/1966 Kilness ..... 192/43.2
5,231,903 A * 8/1993 Bockman, Jr. ..... 81/63.2
5,957,009 A * 9/1999 McCann ..... 81/63.2
6,457,389 B1 * 10/2002 Hu ..... 81/63.2
6,516,692 B1 * 2/2003 Hsien ..... 81/63.2
6,609,444 B1 * 8/2003 Hsien ..... 81/63.2

* cited by examiner

*Primary Examiner*—James G. Smith
(74) *Attorney, Agent, or Firm*—Rosenberg, Klein & Lee

(57) ABSTRACT

A pawl controlling device for a ratchet tool includes a selection member movably connected to the tool and having a through hole in which a bead, a biasing piece and a spring are received, wherein the spring is located between the bead and the biasing piece. The bead is engaged with one of two positioning recesses defined in the slot in which the selection member is received, and the biasing piece is engaged with one of two concavities defined in a side of the pawl which is matched with the engaging member. The pawl is shifted to have one of two ends thereof contacting against an inside of the recess for receiving the pawl.

1 Claim, 5 Drawing Sheets

PAWL SELECTION MECHANISM FOR RATCHET TOOLS

FIELD OF THE INVENTION

The present invention relates to a ratchet tool that has a selection member movably received in the tool and has a biasing piece received therein for engaging with one of two notches in the back of the pawl which is engaged with the engaging member of the ratchet tool.

BACKGROUND OF THE INVENTION

A conventional pawl control device for shifting the pawl to engage with the teeth of the engaging member in the ratchet tool is located in the tool and cannot be accessed. When the pawl is shifted to one direction, the ratchet tool may output a torque in one direction, vice versa. Generally, the pawl has a protrusion at a rear end thereof and the selection member has a shifting portion which pushes the protrusion and shifts the pawl. The user has to exert a large force to shift the pawl.

The present invention intends to provide a pawl selection mechanism wherein a biasing piece is connected to the selection member and engaged with one of two notches in a back of the pawl such that the user shift the pawl easily and the parts of the mechanism is conveniently maintained.

SUMMARY OF THE INVENTION

In accordance with one aspect of the present invention, there is provided a pawl shifting mechanism for a ratchet tool which has a head with a hole defined therethrough so as to receive an engaging member therein, and a recess is defined in an inner periphery of the hole so as to receive a pawl therein. A slot is defined in a side of the head and communicates with the recess. Two positioning recesses are defined in an inner periphery of the slot.

A selection member is movably inserted in the slot and has a through hole for receiving a bead, a spring and a biasing piece. The bead is engaged with one of the two positioning recesses and the biasing piece is engaged with one of the two concavities defined in a back of the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
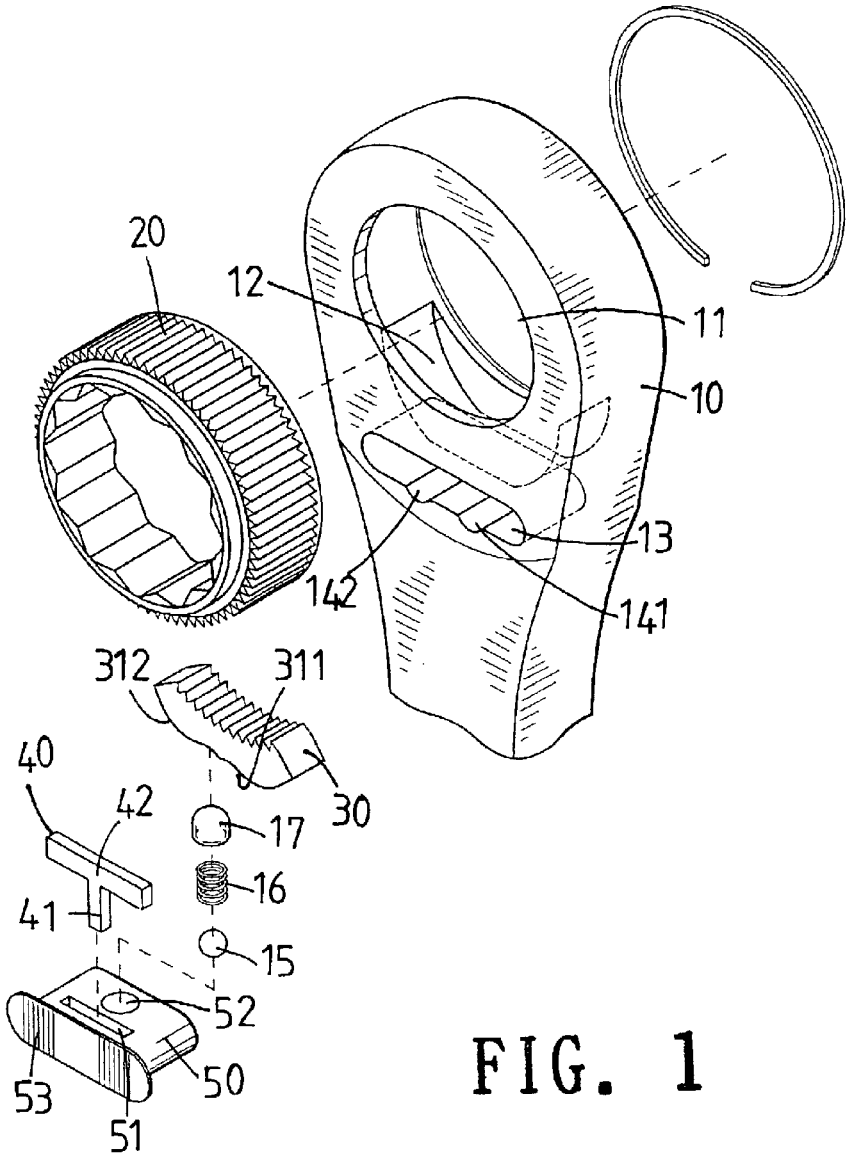
FIG. 1 is an exploded view to show the ratchet tool of the present invention.

Referring to FIGS. 1, 2, 4 and 5, the ratchet tool of the present invention comprises a head 10 having a hole 11 defined therethrough and a shank extends from the head 10. An engaging member 20 with a toothed outer periphery is rotatably received in the hole 11. A recess 12 is defined in an inner periphery of the hole 11 and a pawl 30 is movably received therein. A slot 13 is defined in a side of the head 10 and communicates with the recess 12. Two positioning recesses 141, 142 are defined in an inner periphery of the slot 13.

The pawl 30 has a toothed surface defined in a first side of the pawl 30 and the toothed surface is matched with the toothed outer periphery of the engaging member 20. Two concavities 311,312 are defined in a second side of the pawl 30 and in communication with the slot 13.

A selection member 50 includes a body for being inserted in the slot 13 and a top plate connected to an end of the body. The top plate is located on the side of the tool and includes two knurled portions 53 such that the user may push the top plate at the knurled portions 55 to push the selection member 50 within the slot 13. A through hole 52 is defined through the body of the selection member 50. A bead 15, a spring 16 and a biasing piece 17 are received in the through hole 52, wherein the bead 15 and the biasing piece 17 are respectively biased by two ends of the spring 16. The bead 15 is engaged with one of the two positioning recesses 141,142 to position the selection member 50 at one of two operation positions. The biasing piece 17 is engaged with one of the two concavities 311, 312 of the pawl 30.

An elongated groove 51 is defined in the body of the selection member 50 and a retaining piece 40 has its insertion 41 inserted in the elongated groove 51. The retaining piece 40 has a bar 42 which contacts and retains the biasing piece 17 from being disengaged from the through hole 52.

Figure 2:
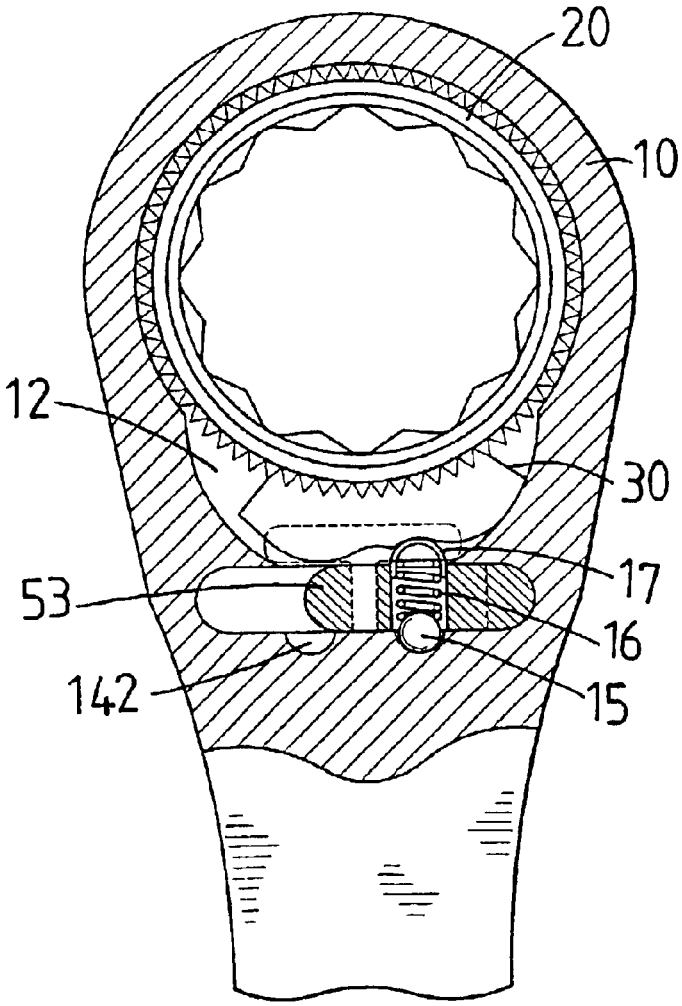
FIG. 2 is a cross sectional view to show the ratchet tool of the present invention, wherein the selection member is moved to the right.

When pushing the selection member 50 to the right as shown in FIG. 2, the bead 15 is engaged with the positioning recess 141 at the right and the biasing piece 17 is engaged with the concavity 311 to let the right end of the pawl to contact against the inside of the recess 12. Therefore, the ratchet tool may tight or loosen an object when rotating counter clockwise.

Figure 3:
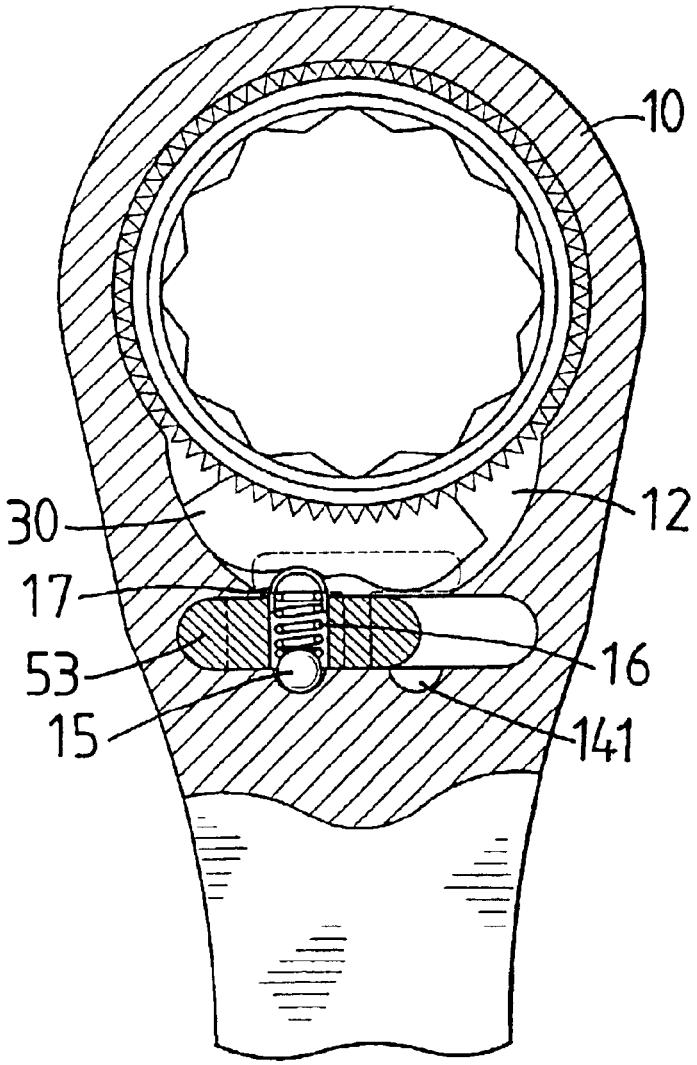
FIG. 3 is a cross sectional view to show the ratchet tool of the present invention, wherein the selection member is moved to the left.
Figure 4:
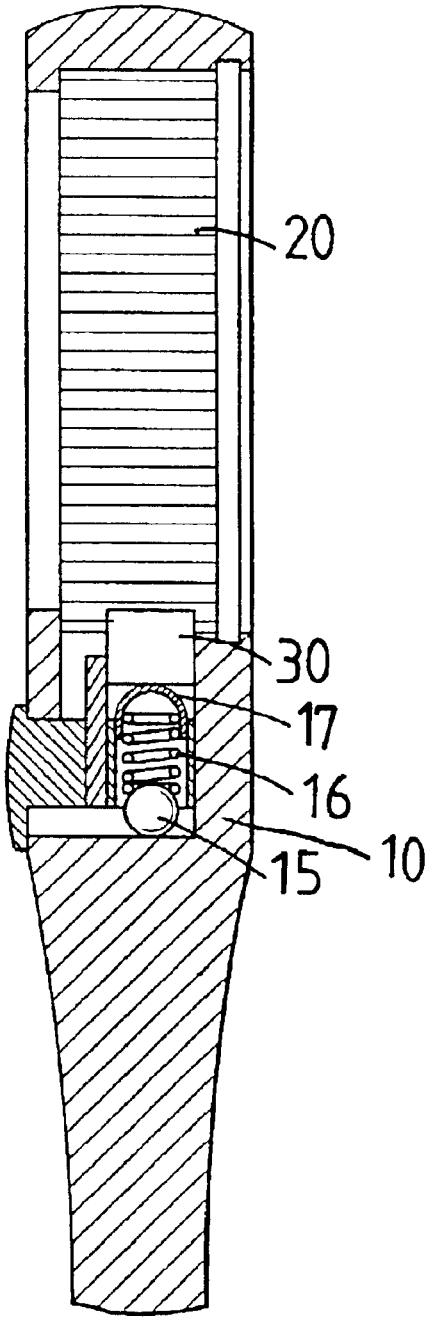
FIG. 4 is a side cross sectional view to show the ratchet tool of the present invention.
Figure 5:
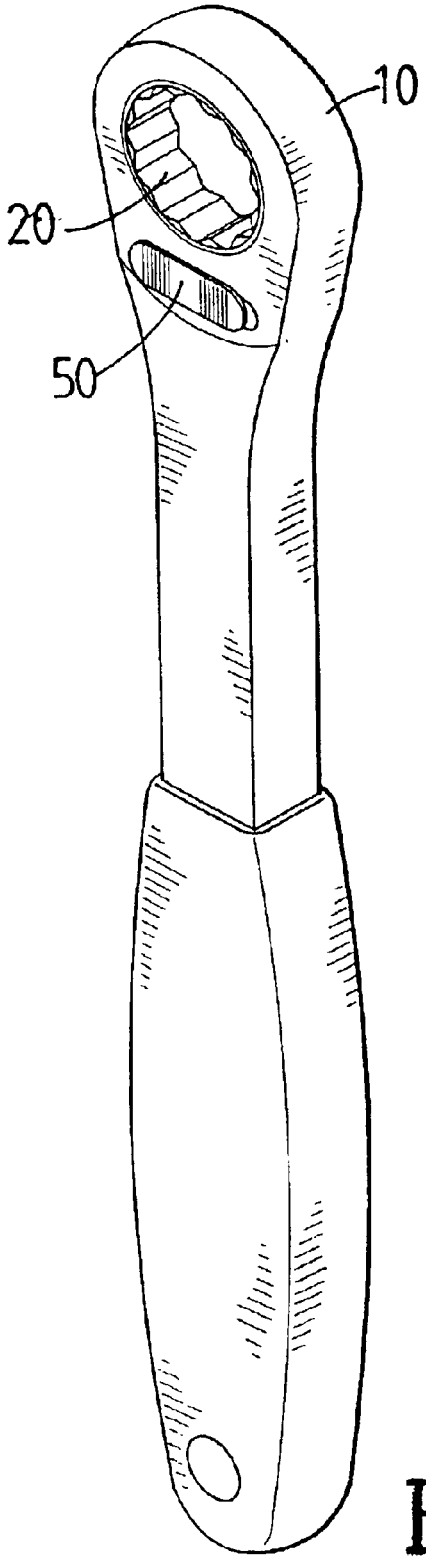
FIG. 5 is a perspective view to show the ratchet tool of the present invention.

Referring to FIG. 3, the selection member 50 can also be pushed to the left and the pawl 30 is then shifted to the left so that the ratchet tool may tight or loosen an object when rotating clockwise.

The selection member 50 can be taken out from the ratchet tool by removing the pin 63 and the spring 16, the bead 15 or the biasing piece 17 is conveniently replaced or maintained.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a recess defined in an inner periphery of the hole, a slot defined in a side of the head and communicating with the recess, two positioning recesses defined in an inner periphery of the slot;

an engaging member rotatably received in the hole of the head and having a toothed outer periphery;

a pawl movably received in the recess and having a toothed surface defined in a first side of the pawl, the toothed surface matched with the toothed outer periphery of the engaging member, two concavities defined in a second side of the pawl, and a selection member movably inserted in the slot and a straight through hole defined through the selection member, a bead, a spring and a biasing piece received in the through hole, the bead and the biasing piece respectively biased by two ends of the spring, the bead engaged with one of the two positioning recesses in the slot and the biasing piece engaged with one of the two concavities of the pawl, the selection member having an elongated groove and a retaining piece inserted in the elongated groove, the retaining piece having a bar which contacts and retains the biasing piece from being disengaged from the through hole, a top plate connected to the selection member and two knurl portions defined in a surface of the top plate.

* * * * *